US007048649B1

(12) United States Patent
Watanabe et al.

(10) Patent No.: US 7,048,649 B1
(45) Date of Patent: May 23, 2006

(54) SOLID MULTI-PIECE GOLF BALL

(75) Inventors: Hideo Watanabe, Chichibu (JP); Yasumasa Shimizu, Chichibu (JP); Akira Kawata, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 343 days.

(21) Appl. No.: 09/667,301

(22) Filed: Sep. 25, 2000

(30) Foreign Application Priority Data

Sep. 30, 1999 (JP) ..... 11-278451

(51) Int. Cl.
*A63B 37/00* (2006.01)
*A63B 37/04* (2006.01)
*A63B 37/06* (2006.01)

(52) U.S. Cl. ..... 473/371; 473/351

(58) Field of Classification Search ..... 473/351, 473/367, 368, 370, 371, 373, 374, 376, 377
See application file for complete search history.

(56) References Cited

U.S. PATENT DOCUMENTS 4,398,000 A * 8/1983 Kataoka et al. ..... 473/374
4,848,770 A * 7/1989 Shama ..... 473/373
5,556,098 A 9/1996 Higuchi et al. ..... 473/373
5,779,561 A * 7/1998 Sullivan et al. ..... 273/DIG. 22
5,830,085 A * 11/1998 Higuchi et al. ..... 473/373
5,935,022 A * 8/1999 Sugimoto et al. ..... 473/373
5,957,784 A * 9/1999 Asakura et al. ..... 473/374
6,187,864 B1 * 2/2001 Rajagopalan ..... 525/183
6,213,896 B1 * 4/2001 Higuchi et al. ..... 473/374

FOREIGN PATENT DOCUMENTS

JP 11253578 A * 9/1999

OTHER PUBLICATIONS

Callister, Jr., William D., Material Science and Engineering: An Introduction, 4th Edition., New York: John Wiley & Sons, inc. copyright 1997, p. 112, 124 and 125.*

* cited by examiner

*Primary Examiner*—Eugene Kim
*Assistant Examiner*—Alvin A. Hunter, Jr.
(74) *Attorney, Agent, or Firm*—Sughrue Mion, PLLC

(57) ABSTRACT

In a solid multi-piece golf ball comprising a solid core, a mantle, and a cover, the ratio of the compression of the mantle to the compression of the solid core is at least 0.98, and the difference in JIS-C hardness between the surface and the center of the solid core is at least 5. This construction and combination of features provide the ball with a good feel when hit with various types of golf clubs and improved distance when struck with a driver.

13 Claims, 1 Drawing Sheet

SOLID MULTI-PIECE GOLF BALL

The present invention relates to a golf ball having a good feel when hit with various types of golf clubs and improved distance when hit with a driver.

BACKGROUND OF THE INVENTION

One of the performance attributes desired in a golf ball is a good feel when the ball is hit. Many attempts have been made to achieve a soft feel by reducing the hardness of the cover, but the soft feel in such cases is often attained at the expense of distance.

On the other hand, improving the distance of the ball generally requires that the cover be made harder, yet a hard cover compromises the feel of the ball on putter and approach shots.

The problem of how to improve both the feel and the distance of a solid golf ball has thus been regarded as intractable.

To this end, we earlier proposed, in Japanese Patent No. 2,658,811, a golf ball having a three-layer construction comprising a center core, an intermediate layer and a cover which effectively resolves this impasse by achieving both an excellent feel and improved distance. Moreover, there is proposed, in U.S. patent application Ser. No. 09/390,290, a multi-piece solid golf ball comprising a solid core, an intermediate layer of at least one layer around the core, and a cover of at least one layer around the intermediate layer, wherein the solid core has a deflection A (mm) under an applied load of 100 kg, and a spherical body consisting of the core and the intermediate layer has a deflection B (mm) under an applied load of 100 kg, the value of B/A being from 1.0 to 1.5. But the high expectations golfers have of the golf balls they use continues to create a need for balls of even better performance.

SUMMARY OF THE INVENTION

It is therefore an object of the present invention to provide a golf ball which has a good feel when hit with various types of clubs and improved distance when struck with a driver.

It has been found that a solid multi-piece golf ball comprising a solid core, a mantle of at least one layer enclosing the solid core and a cover of at least one layer enclosing the mantle, wherein the compressions of the mantle and the solid core are set such as to make the mantle softer and more resilient than in the foregoing prior-art golf balls and the core is given a suitable hardness distribution, has an excellent feel that is very soft on putter and approach shots, even when the cover itself is hard. Moreover, it has also been found that such a ball, when hit with a driver, has a good feel and can achieve an increased distance of travel. Hence, the ball is endowed with an excellent balance of distance and feel.

Accordingly, the invention provides a solid multi-piece golf ball comprising a solid core, a mantle of at least one layer enclosing the solid core, and a cover of at least one layer enclosing the mantle. The mantle and the solid core have a compression ratio, defined as (compression of mantle)/(compression of solid core), of at least 0.98. The solid core has a surface and a center with a difference in JIS-C hardness therebetween, defined as (surface hardness−center hardness), of at least 5.

Preferably, the mantle is made of a material composed primarily of a thermoplastic resin and has a thickness of up to 1.5 mm. The cover typically is made of a material composed primarily of a thermoplastic resin having a Shore D hardness of 60 to 68.

The solid core has a compression of preferably from 3.2 to 4.5 mm, and the compression ratio between the mantle and the solid core is preferably at least 1.00.

The JIS-C hardness difference between the surface and the center of the solid core is preferably at least 8.

BRIEF DESCRIPTION OF THE DRAWING

The only FIGURE.

DETAILED DESCRIPTION OF THE INVENTION

Figure 1:
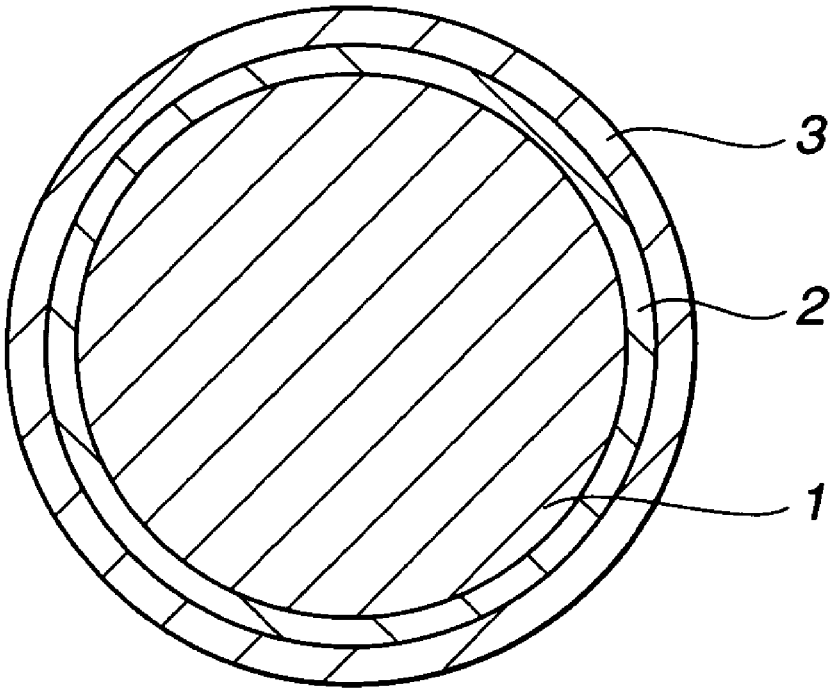
FIG. 1 is a sectional view showing a solid golf ball according to one embodiment of the invention.

Referring to FIG. 1, the golf ball of the invention has a multilayer construction comprising a solid core 1, a mantle 2 enclosing the solid core 1, and a cover 3 enclosing the mantle 2. In FIG. 1, the solid core 1, mantle 2 and cover 3 are each composed of a single layer, although any or all of these parts of the ball may have a construction composed of two or more layers of different materials.

The solid core 1 may be made of a known rubber composition, and preferably one in which polybutadiene is used as the base material. The use of 1,4-polybutadiene having cis configuration of at least 40% is especially suitable.

A crosslinking agent may be included in the rubber composition. Exemplary crosslinking agents include the zinc and magnesium salts of unsaturated fatty acids, such as zinc methacrylate and zinc acrylate, and ester compounds such as trimethylpropane methacrylate. Zinc acrylate is especially preferred for achieving a high resilience. The crosslinking agent is preferably included in an amount of 10 to 35 parts by weight per 100 parts by weight of the base rubber.

A vulcanizing agent such as dicumyl peroxide or a mixture of dicumyl peroxide and 1,1-bis(t-butylperoxy)-3,3,5-trimethylcyclohexane is generally included in the rubber composition. The amount of vulcanizing agent included in the rubber composition is preferably from 0.1 to 5 parts by weight per 100 parts by weight of the base rubber. Advantageously, use can be made of a commercial product such as Percumyl D (manufactured by Nippon Oils and Fats Co., Ltd.) as the dicumyl peroxide.

If necessary, other suitable ingredients may also be incorporated in the rubber composition, such as antioxidants and fillers (e.g., zinc oxide, barium sulfate) for modifying the specific gravity. The amount of such fillers included in the composition is typically from 0 to 130 parts by weight per 100 parts by weight of the base rubber.

The solid core may be produced from the above rubber composition by using a conventional blending apparatus such as a Banbury mixer, kneader or roll mill to blend the ingredients into a compound, then injection-molding or compression-molding the compound in a core mold.

It is recommended that the resulting solid core have a diameter of generally at least 32.0 mm, and preferably at least 35.0 mm, but not more than 38.7 mm, and preferably not more than 37.0 mm.

In the practice of the invention, it is essential for the solid core to have a compression in a given ratio with respect to the compression of the mantle. "Compression," as used herein, refers to the amount of deflection, or deformation, a ball or ball component incurs when subjected to a load of 1,275 N (130 kgf) from an initial load of 98 N (10 kgf). The compression of the solid core is adjusted in accordance with the compression of the mantle and should preferably be at least 3.2 mm, and more preferably at least 3.5 mm, but not more than 4.5 mm, and more preferably not more than 4.2 mm. A solid core having too soft compression may give the golf ball insufficient rebound and thus result in a shortened distance of travel. On the other hand, a solid core with a compression that is too hard may cause the ball to incur excessive spin on impact with a driver, which can also shorten the distance of travel by the ball.

Not only must the solid core have a compression which provides an appropriate compression ratio, it must also have a suitable distribution in JIS-C hardness. Namely, it is critical for the solid core to have a JIS-C hardness at the surface thereof which is greater than the JIS-C hardness at the center of the core, and for the difference in JIS-C hardness therebetween, defined as (surface hardness−center hardness), to be at least 5, and preferably at least 8. Too small a difference in the JIS-C hardness within the solid core may result in excessive spin by the ball, lowering the distance of travel. It is recommended that the upper limit in the difference in JIS-C hardness be not more than 22, and preferably not more than 20.

In the golf ball of the invention, the solid core may be made of a material other than the rubber composition described above, in which case the material should be suitably modified to give the above-described hardness distribution within the solid core and the above-described ratio in mantle compression to solid core compression, such as by the use of the thermoplastic resins mentioned subsequently as mantle materials and cover materials.

The mantle 3, as shown in FIG. 1, is an intermediate layer between the solid core 1 and the cover 3. In the practice of the invention, a mantle which is a soft layer having the compression indicated below and which is preferably formed to a low thickness provides, in association with the above-described hardness distribution in the solid core, synergistic effects that enhance the flight performance and feel of the inventive golf ball.

The mantle may be formed of a known thermoplastic resin. For example, preferred use can be made of a resin composed primarily of a thermoplastic elastomer. Illustrative examples include polyester, polyamide, polyurethane, polyolefin, polystyrene and other thermoplastic elastomers. Specific commercial products that may be used for this purpose include Hytrel (DuPont-Toray Co., Ltd.), Pelprene (Toyobo Co., Ltd.), Pebax (Toray industries, Inc.), Pandex (Dainippon Ink & Chemicals, Inc.), Santoprene (Monsanto Chemical Co.) and Tuftec (Asahi Kasei Kogyo Co., Ltd.).

When the foregoing thermoplastic elastomer is used, the Shore D hardness of the elastomer proper is not subject to any particular limitation. Use may be made of a relatively soft material generally having a Shore D hardness of at least 15, and preferably at least 25, more preferably at least 30, but not more than 50, and preferably not more than 40. An especially preferred example of a commercial product which may be used for this purpose is Hytrel 3078 (DuPont-Toray Co., Ltd.) having a Shore D hardness of 30.

The mantle may be formed by injection-molding the above-described material using a process wherein a prefabricated solid core is placed at a predetermined position within an injection mold, following which the mantle-forming material is introduced into the mold. Alternatively, use may be made of a compression molding process in which a pair of hemispherical cups are fashioned from the above material, following which the cups are placed over a solid core and molded under heat and pressure in a mold.

No particular limitation is imposed on the thickness to which the mantle is formed. However, to reliably enhance the feel and distance performance of the ball, it is recommended that the mantle have a thickness which is not more than 1.5 mm and preferably not more than 1.3 mm, but at least 0.2 mm, and preferably at least 0.8 mm.

In the practice of the invention, it is critical for the ratio between the compression of the mantle and the compression of the solid core, defined as (mantle compression/solid core compression), to be adjusted so as to be at least 0.98, and preferably at least 1.00. At a compression ratio lower than 0.98, an optimal feel on taking a putter or iron shot cannot be achieved. It is generally advantageous for the compression ratio to be no higher than 1.08, and especially 1.05. A compression ratio which is too high may lower the ball's resilience and thus reduce the distance traveled by the ball.

The mantle preferably has a compression of at least 3.2 mm, and more preferably at least 3.5 mm, but not more than 4.5 mm, and more preferably not more than 4.2 mm.

In the golf ball of the invention, the surface of the above-described mantle 2 is enclosed within a cover 3 which may be made of a known material composed primarily of a thermoplastic resin. Exemplary cover materials include ionomer resins such as the commercial products Himilan (DuPont-Mitsui Polychemicals Co., Ltd.), Surlyn (E.I. DuPont de Nemours and Company) and Iotek (Exxon Chemical Company).

It is recommended that the cover be made of a thermoplastic resin which gives the cover a Shore D hardness of at least 60, and preferably at least 62, but not more than 68, and preferably not more than 65. At a low Shore D hardness, the resilience of the ball may decline and the spin may increase, resulting in a reduced distance of travel. On the other hand, too high a Shore D hardness tends to give the ball a hard feel when hit.

The above-described primary constituent of the cover may have compounded therewith suitable amounts of various additives such as inorganic fillers. Examples of inert fillers that may be used include barium sulfate and titanium dioxide. Inorganic fillers such as these may also be surface treated to facilitate dispersion within the cover material.

The cover may be fashioned from the above material by a process similar to the processes described above for forming the mantle, such as injection molding or compression molding. For example, when an injection molding process is used, the solid core over which the mantle has been formed is placed in an injection mold, following which the cover material is introduced into the mold and molded over the mantle.

The thickness of the resulting cover is not subject to any particular limitation. However, it is advisable to form the cover to a thickness of generally at least 0.2 mm, and preferably at least 1.0 mm, but not more than 5.0 mm and preferably not more than 2.5 mm.

As in conventional golf balls, the golf ball of the invention has numerous dimples formed on the surface of the cover. If necessary, the surface may be subjected to finishing treatment such as painting and stamping.

No particular limitation is imposed on the compression of the inventive golf ball itself. However, it is generally advisable for this to be at least 2.2 mm, and preferably at least 2.5 mm, but not more than 3.5 mm, and preferably not more than 3.2 mm.

The golf ball of the invention may be formed so as to have a diameter and weight which conform with the Rules of Golf. That is, the ball may have a diameter of at least 42.67 mm and a weight of not more than 45.93 g.

The inventive golf ball has a good feel when hit with various types of golf clubs and improved distance when struck with a driver.

EXAMPLE

Examples of the invention and comparative examples are given below by way of illustration, and are not intended to limit the invention.

Examples and Comparative Examples

In each example, the rubber composition shown in Table 1 was introduced into a core mold to produce a solid core having the hardness distribution indicated in the table. Next, a mantle and/or cover was formed using the materials shown in Table 2 in accordance with the specifications of Table 3, giving golf balls bearing dimples in the same arrangement and shape on the surface.

The trade names mentioned in Table 2 represent the following materials.

Hytrel: A thermoplastic polyester elastomer made by DuPont-Toray Co., Ltd.

Pelprene: A thermoplastic polyester elastomer made by Toyobo Co., Ltd.

Himilan: An ionomer resin made by DuPont-Mitsui Polychemicals Co., Ltd.

The properties of the golf balls obtained in the examples were measured and evaluated as described below. The results are shown in Table 3.

Compression:

The compression was determined by measuring the amount of deflection, or deformation, by the ball or ball component being measured when subjected to a load of 1275 N (130 kgf) from an initial load of 98 N (10 kgf).

Performance:

The golf balls obtained in each example were measured for spin rate, carry and total distance when hit with a driver (W#1) at a head speed of 40 m/s using a swing robot. Flight performance was rated as follows based on the total distance of each ball.

VG: Very good flight (total distance of at least 195 m)

Good: Good flight (total distance of at least 193 m but less than 195 m)

Poor: Poor (total distance of less than 193 m) Feel:

The feel of each ball when hit with a driver (W#1), No. 9 iron (I#9) and a putter was rated as follows.

VG: Very good

Good: Good, soft feel

Fair: Somewhat hard

Poor: Hard

TABLE 1

| Core composition | EX | | | | CE | | | | |
|---|---|---|---|---|---|---|---|---|---|
| (parts by weight) | 1 | 2 | 3 | 4 | 1 | 2 | 3 | 4 | 5 |
| Polybutadiene | 100 | 100 | 100 | 100 | 100 | 100 | 100 | 100 | 100 |
| Zinc diacrylate | 25.5 | 25.5 | 26.2 | 26.2 | 26.2 | 29.0 | 24.5 | 26.2 | 23.6 |
| Dicumyl peroxide | 1 | 1 | 1 | 1 | 1 | 1 | 1 | 1 | 1 |
| Antioxidant | 0.1 | 0.1 | 0.1 | 0.1 | 0.1 | 0.1 | 0.1 | 0.1 | 0.1 |
| Barium sulfate | 17.31 | 18.93 | 19.88 | 19.28 | 17.55 | 16.7 | 18.7 | 16.94 | 17.96 |
| Zinc oxide | 5 | 5 | 5 | 5 | 5 | 5 | 5 | 5 | 5 |
| Zinc salt of pentachlorothiophenol | 0.1 | 0.2 | 0.2 | 0.2 | 0.2 | 0.2 | 0.2 | 0.2 | 0.1 |
| Primary vulcanization conditions | | | | | | | | | |
| Temp (° C.) | 155 | 155 | 155 | 155 | 155 | 155 | 155 | 145 | 155 |
| Time (min) | 15 | 15 | 15 | 15 | 15 | 15 | 15 | 30 | 15 |
| Secondary vulcanization conditions | | | | | | | | | |
| Temp (° C.) | | | | | | | | 170 | |
| Time (min) | | | | | | | | 10 | |
| Core hardness (JIS-C) | | | | | | | | | |
| (1) Surface hardness | 72 | 72 | 73 | 73 | 73 | 76 | 71 | 70 | 72 |
| (2) Center hardness | 63 | 63 | 63 | 63 | 63 | 66 | 62 | 67 | 63 |
| (1)–(2) | 9 | 9 | 10 | 10 | 10 | 10 | 9 | 3 | 9 |

TABLE 2

| Mantle and cover compositions (pbw) | a | b | c | d | e |
|---|---|---|---|---|---|
| Hytrel 3078 | 100 | | | | |
| Hytrel 4047 | | 100 | | | |
| Hytrel 4767 | | | 100 | | |
| Pelprene P30B | | | | 100 | |
| Himilan 1706 | | | | | 50 |
| Himilan 1605 | | | | | 50 |
| Titanium dioxide | | | | | 5.6 |
| Resin hardness (Shore D) | 30 | 40 | 47 | 25 | 63 |
| Specific gravity | 1.080 | 1.121 | 1.157 | 1.050 | 0.985 |

TABLE 3

| | EX | | | | CE | | | | |
|---|---|---|---|---|---|---|---|---|---|
| | 1 | 2 | 3 | 4 | 1 | 2 | 3 | 4 | 5 |
| Solid core | | | | | | | | | |
| Weight (g) | 28.74 | 28.97 | 29.14 | 28.01 | 26.81 | 27.65 | 27.53 | 28.74 | 35.07 |
| Diameter (mm) | 36.11 | 36.11 | 36.11 | 35.68 | 35.25 | 35.59 | 35.54 | 36.11 | 38.60 |
| Compression (mm) | 4.01 | 4.01 | 3.91 | 3.91 | 3.89 | 3.49 | 4.16 | 3.9 | 4.0 |
| Mantle | | | | | | | | | |
| Type | b | a | d | a | b | c | c | a | |
| Hardness (Shore D) | 40 | 30 | 25 | 30 | 40 | 47 | 47 | 40 | |
| Weight (g) | 35.07 | 35.07 | 35.07 | 35.07 | 35.07 | 35.07 | 35.07 | 35.07 | |
| Diameter (mm) | 38.68 | 38.68 | 38.68 | 38.68 | 38.68 | 38.56 | 38.56 | 38.68 | |
| Compression (mm) | 4.05 | 4.13 | 4.05 | 3.82 | 3.71 | 3.18 | 3.8 | 4.03 | |
| Cover | | | | | | | | | |
| Type | e | e | e | e | e | e | e | e | e |
| Compression ratio (mantle/core) | 1.01 | 1.03 | 1.04 | 0.98 | 0.95 | 0.91 | 0.91 | 1.03 | — |
| Ball | | | | | | | | | |
| Weight (g) | 45.3 | 45.3 | 45.3 | 45.3 | 45.3 | 45.3 | 45.3 | 45.3 | 45.3 |
| Diameter (mm) | 42.7 | 42.7 | 42.7 | 42.7 | 42.7 | 42.7 | 42.7 | 42.7 | 42.7 |
| Compression (mm) | 3.15 | 3.23 | 3.15 | 3.10 | 3.00 | 2.53 | 2.90 | 3.16 | 3.06 |
| W#1 (HS = 40) | | | | | | | | | |
| Carry (m) | 185.0 | 185.3 | 185.2 | 184.7 | 185.1 | 185.0 | 184.5 | 182.4 | 184.0 |
| Total distance (m) | 195.5 | 194.1 | 193.3 | 193.2 | 194.7 | 194.3 | 194.7 | 189.6 | 194.9 |
| Flight performance | VG | Good | Good | Good | Good | Good | Good | Poor | Good |
| Spin (rpm) | 2727 | 2825 | 2875 | 2830 | 2785 | 2735 | 2638 | 3075 | 2670 |
| Feel | Good | Good | Good | Good | Good | Fair | Good | Good | Good |
| I#9 | | | | | | | | | |
| Feel | Good | Good | VG | VG | Good | Fair | Fair | Good | Fair |
| Putter | | | | | | | | | |
| Feel | Good | Good | Good | Good | Fair | Fair | Fair | Good | Poor |

As is apparent from the results in Table 3, the golf balls according to the invention all had an excellent flight performance and a good feel when hit with different types of golf clubs. By contrast, the golf balls obtained in the comparative examples had the following drawbacks.

Comparative Example 1: The ball had a somewhat hard feel when hit with a putter.

Comparative Example 2: The ball had a somewhat hard feel when hit with a driver, an iron or a putter.

Comparative Example 3: The ball had a somewhat hard feel when hit with an iron and when hit with a putter.

Comparative Example 4: The flight performance of the ball when struck with a driver was the poorest of all the examples and comparative examples.

Comparative Example 5: The ball had a somewhat hard feel when hit with an iron, and an even harder feel when hit with a putter.

Japanese Patent Application No. 11-278451 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A solid multi-piece golf ball comprising a solid core, a mantle of at least one layer enclosing the solid core, and a cover of at least one layer enclosing the mantle, wherein the mantle is made of a material composed primarily of a thermoplastic elastomer selected from the group consisting of polyester, polyamide, polyolefin, and polystyrene, and has a thickness of up to 1.5 mm, the mantle and the solid core have a compression ratio, defined as (compression of mantle)/(compression of solid core), of at least 0.98, the compression being the amount of deformation when subjected to a load of 1,275 N from an initial load of 98 N, and the solid core has a compression of 3.2 to 4.5 mm and has a surface and a center with a difference in JIS-C hardness therebetween, defined as (surface hardness−center hardness), of at least 5, and the cover is made of a material composed primarily of a thermoplastic resin having a Shore D hardness of 60 to 68.

2. The golf ball of claim 1, wherein the compression ratio between the mantle and the solid core is at least 1.00.

3. The golf ball of claim 1, wherein JIS-C hardness difference between the surface and the center of the solid core is at least 8.

4. The golf ball of claim 1, wherein the solid core has a diameter of at least 32.0 mm.

5. The golf ball of claim 1, wherein the JIS-C hardness difference between the surface and the center of the solid core is less than 22.

6. The golf ball of claim 1, wherein the JIS-C hardness difference between the surface and the center of the solid core is less than 20.

7. The golf ball of claim 1, wherein the compression ratio of the mantle and the solid core is less than 1.08.

8. The golf ball of claim 1, wherein the compression ratio of the mantle and the solid core is less than 1.05.

9. The golf ball of claim 1, wherein the Shore D hardness of the mantle is from 15 to 30.

10. The golf ball of claim 1, wherein the Shore D hardness of the mantle is from 25 to 40.

11. The golf ball of claim 1, wherein the mantle has a thickness of up to 1.3 mm.

12. The golf ball of claim 1, wherein the Shore D hardness of the mantle is less than the Shore D hardness of the surface of the solid core.

13. The golf ball of claim 1, wherein the specific gravity of the mantle is 1.050 to 1.121.

* * * * *